US008867769B2

(12) United States Patent
Naumann et al.

(10) Patent No.: US 8,867,769 B2
(45) Date of Patent: Oct. 21, 2014

(54) BEHIND-THE-EAR HEARING AID HAVING A PLUG-IN CONNECTOR

(75) Inventors: Frank Naumann, Erlangen (DE); Holger Kral, Fuerth (DE); Andreas Ratay, Erlangen (DE); Joachim Roland Barth, Nuremberg (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 8 days.

(21) Appl. No.: 13/578,728

(22) PCT Filed: Apr. 20, 2010

(86) PCT No.: PCT/EP2010/055194

§ 371 (c)(1), (2), (4) Date: Aug. 13, 2012

(87) PCT Pub. No.: WO2011/098153

PCT Pub. Date: Aug. 18, 2011

(65) Prior Publication Data

US 2012/0328139 A1 Dec. 27, 2012

Related U.S. Application Data

(60) Provisional application No. 61/319,919, filed on Apr. 1, 2010.

(30) Foreign Application Priority Data

Feb. 11, 2010 (DE) ..... 10 2010 007 846

(51) Int. Cl.
*H04R 25/00* (2006.01)

(52) U.S. Cl.
CPC ..... *H04R 25/60* (2013.01); *H04R 2225/63* (2013.01); *H04R 2225/021* (2013.01); *H04R 25/405* (2013.01)
USPC ..... 381/330; 381/323

(58) Field of Classification Search
USPC ..... 381/60, 322, 324, 328, 330, 323
See application file for complete search history.

(56) References Cited

U.S. PATENT DOCUMENTS 5,987,146 A 11/1999 Pluvinage et al.
6,094,493 A 7/2000 Borowsky et al.
(Continued)

FOREIGN PATENT DOCUMENTS

DE 102005019994 A1 11/2006
DE 102006045484 A1 4/2008
(Continued)

*Primary Examiner* — Davetta W Goins
*Assistant Examiner* — Phylesha Dabney
(74) *Attorney, Agent, or Firm* — Laurence A. Greenberg; Werner H. Stemer; Ralph E. Locher

(57) ABSTRACT

A behind-the-ear hearing device has a housing with a plug-in connector on a sidewall of the housing for connecting to an earpiece tube or sound tube. The lateral arrangement of the plug-in connector moves the plug-in connector away from the exposed position on the front end face of the housing. This enables the front end face, which is generally visible, to be made smaller. Advantageously, at least two microphones are provided, with one microphone position in the vicinity of the front end face of the housing. The front microphone position is thus moved farther away from a position that may possibly be covered by the pinna, and the rear microphone position can also be moved farther toward the front. The microphone positions are thus approximately horizontal, which promotes the spatial resolution of the detected surrounding sound (directionality) by the signal processing of the hearing aid.

5 Claims, 2 Drawing Sheets

(56) References Cited

U.S. PATENT DOCUMENTS

| | | | | |
|---|---|---|---|---|
| 7,027,608 | B2 | 4/2006 | Fretz et al. | |
| 7,110,562 | B1 | 9/2006 | Feeley et al. | |
| 7,606,382 | B2 * | 10/2009 | Feeley et al. | 381/330 |
| 8,023,674 | B2 * | 9/2011 | Schumaier et al. | 381/324 |
| 8,050,437 | B2 * | 11/2011 | Feeley et al. | 381/322 |
| 8,094,850 | B2 * | 1/2012 | Feeley et al. | 381/322 |
| 8,311,252 | B2 * | 11/2012 | Dittli et al. | 381/324 |
| 8,379,897 | B2 * | 2/2013 | Schumaier | 381/326 |
| 8,452,021 | B2 * | 5/2013 | Yanz et al. | 381/60 |
| 2003/0002700 | A1 | 1/2003 | Fretz et al. | |
| 2003/0142843 | A1 | 7/2003 | Meier | |
| 2005/0190939 | A1 | 9/2005 | Fretz | |
| 2005/0248717 | A1 * | 11/2005 | Howell et al. | 351/41 |
| 2007/0009130 | A1 * | 1/2007 | Feeley et al. | 381/330 |
| 2007/0064965 | A1 * | 3/2007 | Feeley et al. | 381/328 |
| 2008/0260192 | A1 | 10/2008 | Yanz et al. | |
| 2008/0273733 | A1 | 11/2008 | Bauman et al. | |
| 2009/0074221 | A1 | 3/2009 | Westermann | |
| 2009/0180653 | A1 | 7/2009 | Sjursen et al. | |
| 2009/0182688 | A1 | 7/2009 | van der Zwan et al. | |
| 2009/0304216 | A1 * | 12/2009 | Hansen | 381/324 |
| 2011/0019849 | A1 * | 1/2011 | Nielsen | 381/322 |

FOREIGN PATENT DOCUMENTS

| | | | |
|---|---|---|---|
| JP | 11510345 | A | 9/1999 |
| JP | 2001510976 | A | 8/2001 |
| JP | 2002506335 | A | 2/2002 |
| JP | 2008542820 | A | 11/2008 |
| WO | 9706651 | A1 | 2/1997 |
| WO | 2008095489 | A1 | 8/2008 |

* cited by examiner

BEHIND-THE-EAR HEARING AID HAVING A PLUG-IN CONNECTOR

BACKGROUND OF THE INVENTION

Field of the Invention

The invention relates to a behind-the-ear hearing device (BTE) having a plug-in connector for a sound tube or earpiece tube.

A hearing device is used to supply a hearing-impaired person with acoustic ambient signals which are processed and amplified to compensate for and/or treat the respective hearing impairment. It consists in principle of one or several input transducers, a signal processing facility, an amplification facility and an output transducer. The input transducer is generally a sound receiver, e.g. a microphone and/or an electromagnetic receiver, e.g. an induction coil. The output signal generator is generally realized as an electro acoustic converter, e.g. miniature loudspeaker, or as an electromechanical converter, e.g. bone conduction earpiece. It is also referred to as earpiece or receiver. The output signal generator generates output signals, which are routed to the ear of the patient and are to generate a hearing perception in patients. The amplifier is generally integrated in the signal processing facility. The power supply into the hearing device is effected by a battery integrated in the hearing device housing. The main components of a hearing device are generally arranged on a printed circuit board as a circuit carrier and/or connected thereto.

Hearing devices are known in various basic housing configurations. With ITE hearing devices (In-The-Ear), a housing, which contains all functional components including microphone and receiver, is for the large part worn in the auditory canal. CIC hearing devices (Completely-In-Canal) are similar to the ITE hearing devices, but are however worn completely in the auditory canal. With BTE hearing devices (Behind-The-Ear) a housing with components such as a battery and signal processing facility is worn behind the ear and a flexible sound tube, also known as tube, routes the acoustic output signals of a receiver from the housing to the auditory canal. RIC-BTE hearing devices (Receiver-In-Canal Behind-The-Ear) are similar to the BTE hearing devices, but the receiver is nevertheless worn in the auditory canal and instead of acoustic signals, the flexible earpiece tube routes electrical signals to the receiver, which is attached to the front of the earpiece tube. Common to all housing configurations is that attempts are made to achieve the smallest possible housing, in order to increase wearing comfort and to reduce the visibility of the hearing device for cosmetic reasons.

RIC-BTE hearing devices can be equipped with several microphones, in order to enable a spatial resolution of the ambient sound received by the microphone. The term directionality is used. To enable directionality, a number of microphones is arranged spatially separate from one another. It is clear that the spatial arrangement of the microphones relative to one another and to the ear of the hearing device wearer and in the room has an influence on the spatial resolution.

RIC-BTE hearing devices include a housing to be worn behind the ear or the auricle of the hearing device wearer as well as a receiver to be worn in the auditory canal. The housing and receiver are connected to one another by means of an earpiece tube, which inter alia includes an electrical line, by means of which electrical output signals of the housing are routed to the receiver. The housing and earpiece tube are generally detachably connected to one another, e.g. by means of a plug-in connector.

FIG. 1 shows a conventional RIC-BTE hearing device according to the prior art described above, nevertheless without a receiver. It includes a housing 1 to be worn behind the auricle of a hearing device wearer. Aside from further electronic components (not shown), two microphones 2 are arranged in the housing. One of the microphones 2 is arranged at a position further toward the front and is therefore referred to as the front microphone FM, the other microphone 2 is arranged at a position further toward the rear and is therefore also referred to as the rear microphone RM.

For electrical connection with a receiver, the housing includes a socket 3. The socket 3 is part of a plug-in connector, by means of which an earpiece tube 5 can be detachably connected to the electronic components of the housing 1 by way of the connector 4. The plug-in connector is arranged on the front end face of the longitudinal housing 1. This end face of the housing 1 protrudes, if the housing is worn conventionally behind the ear of a hearing device wearer, towards the upper front edge of the auricle and possibly even beyond this, and can therefore be visible from the front and possibly also from the side. A receiver (not shown) is attached to the other end of the earpiece tube 5 (similarly not shown), said receiver being arranged worn in the auditory canal of the hearing device wearer.

The afore-described previously known RIC-BTE hearing device is disadvantageous inter alia in that on account of its exposed position to the front of the housing 1 and also on account of its size, the connector 4 is very obvious and is less optically pleasing from aesthetic and cosmetic points of view. A further disadvantage is that the microphones 2, which are arranged behind the connector 4, are both arranged so far behind the housing 1 that they can possibly be partially covered by the ear and/or the auricle of the hearing device wearer, thereby interfering with receipt of acoustic ambient signals.

A further disadvantage is that the microphones 2 are arranged at different heights following the contour of the auricle, namely the rear microphone 2 below the front microphone 2, whereas an arrangement at the same height would be more favorable for the directionality and/or directionality index.

The publication U.S. Pat. No. 5,987,146 A discloses a hearing instrument having a housing to be worn outside of an auditory canal and having several tubes leading into the auditory canal. A receiver is arranged at the end of one of the tubes on the auditory canal side, a microphone can be arranged at the end of a further of the tubes on the auditory canal side. At the front face of the hearing instrument, the tubes are connected herewith and measured such that the auditory canal is not completely closed (open fit) so that ambient noises can reach the ear via the tubes.

The publication US 2008/0273733 A1 discloses a RIC-BTE hearing device, in which a plug-in connector for the earpiece tube is arranged on the front face of the hearing device housing and a microphone opposite the plug-in connector is moved to the topside of the hearing device which inclines toward the front face. A similar hearing device is also known from the publication WO 2008/095489 A1.

The publication U.S. Pat. No. 7,027,608 B2 discloses a BTE hearing device having a premolded sound tube, which leads into the auditory canal and does not completely block the same. The sound tube is connected to a plug-in connector on the front face of the hearing device housing. Similarly, a microphone is arranged on the front face of the hearing device housing.

The publication U.S. Pat. No. 7,110,562 B1 discloses a RIC-BTE hearing device, in which a microphone and a plug-in connector for the earpiece tube are likewise arranged on the front face of the hearing device housing.

BRIEF SUMMARY OF THE INVENTION

The object of the invention consists in specifying an aesthetically pleasing BTE hearing device having a smaller end face and improved acoustic properties.

The invention achieves this object with a hearing device having the features of the main claim.

According to a basic idea of the invention, a hearing device includes a housing to be worn behind the ear of a hearing device wearer, in which a plug-in connector is arranged for connection with an earpiece tube or a sound tube, wherein the plug-in connector is arranged on a side wall of the housing.

The lateral arrangement of the plug-in connector moves the plug-in connector away from the exposed position on the front end face of the housing. As a result, the front end face of the housing, wherein said front end face is generally visible at least from the front for a housing worn behind the ear, is made smaller, furthermore, it can be embodied to be freer and more optically obvious due to the omission of the plug-in connector. Furthermore, a smaller end face brings about a lower attenuation of acoustic signals, which strike the hearing device worn on the ear from the front.

The terms "front", "rear", "above" and "below" are in each instance understood above and below based on the hearing device housing worn behind the ear. "Front" therefore refers to an alignment in the field of view of the hearing device wearer and "below" an alignment in the vertical direction downwards and thus coming from above toward the ear of the hearing device wearer.

According to an advantageous development, the plug-in connector is arranged on a lower lying side wall of the housing directed toward the ear when the housing is worn behind the ear of a hearing device wearer, which is also referred to as base and/or "bottom surface" in the case of hearing devices. The side directed at the ear is protected from view, which renders this positioning of the plug-in connector less obvious. Furthermore, it is also not directly exposed in an unprotected fashion to possibly damaging environmental influences, such as moisture or dirt, which renders the positioning also more prone to interfering influences.

According to an advantageous development, the housing of the hearing device comprises a longitudinal shape and the plug-in connector is arranged on a longitudinal side wall of the housing. The longitudinal side wall offers a relatively large surface compared with the end faces, which can be used to position the plug-in connector. Greater creative freedom is thus ensured with respect to the plug-in connector and its locking mechanisms. The greater creative freedom can also be used to seal the plug-in connector relative to the housing thereby also improving the stability of the overall system.

According to an advantageous development, the hearing device includes a microphone, which is connected to a microphone opening. The microphone opening is arranged at a microphone position in the region of a front end face of the housing.

The lateral arrangement of the plug-in connector has free space at the front end face of the housing and therefore ensures greater creative freedom. This is used to provide the front microphone position on the front end face. The front microphone position is therefore moved further away from a position possibly covered by the auricle, which favors the recording of acoustic ambient signals.

According to a further advantageous development, the hearing device includes at least two microphones, which are each connected to a microphone opening. The microphone openings are arranged at microphone positions which are spatially separate from one another, wherein one of the microphone positions is arranged in the region of a front end face of the housing.

The lateral arrangement of the plug-in connector has free space at the front end face of the housing and therewith ensures greater creative freedom. This is used to provide the front microphone position on the front end face. The front microphone position is therefore moved further away from a position possibly covered by the auricle, which favors the recording of acoustic ambient signals. On the other hand, the rear microphone position can also be moved further toward the front as a result of a front microphone position arranged further forward to the front. Both microphone positions are therefore preferably arranged above the ear rather than behind the ear and can be arranged at least approximately at the same height, on a horizontal line when the head of the hearing device wearer is upright. The horizontal arrangement at the same height favors the spatial resolution of the received ambient sound (directionality) through the signal processing of the hearing device.

According to an advantageous development of the previously described hearing device with a longitudinal housing, at least two microphones are included, which are each connected to a microphone opening, wherein the microphone openings are arranged at microphone positions which are spatially separate from one another. One of the microphone positions is arranged in a longitudinal side wall of the housing, and a further microphone position is arranged in an end face of the housing. As a result, the free space on the front end face of the housing room is used to provide the front microphone position on the front end face. The arrangement of a further microphone in one of the longitudinal side walls, namely preferably the side wall oriented upward away from the ear when the hearing device is worn on the ear, produces a position of the microphone covered as little as possible by the auricle approximately horizontally at the same height. The horizontal arrangement favors the spatial resolution of the received ambient sound (directionality) through the signal processing of the hearing device.

It is apparent that the described arrangement of a correspondingly flat plug-in connector which is embodied with a minimal cross-section can be used to embody the housing of the hearing device to be flatter overall or less 2-dimensional, in order to increase wearing comfort and to achieve an aesthetically more pleasing design. In particular, the front end face of the housing which is more visible from the front can also be embodied flatter or less 2-dimensionally.

Further advantageous developments result from the subsequent figures plus description, in which;

DESCRIPTION OF THE INVENTION

Figure 1:
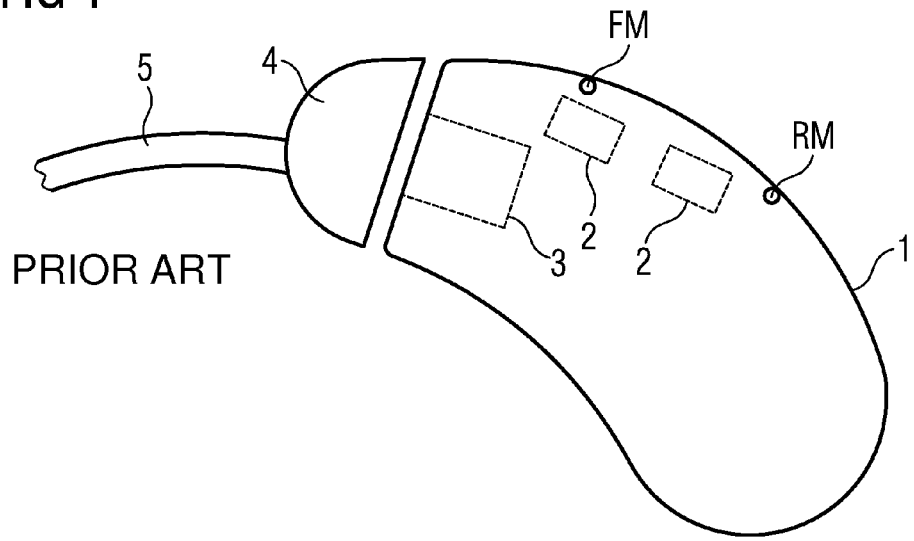
FIG. 1 shows a conventional RIC-BTE hearing device according to the prior art.
Figure 2:
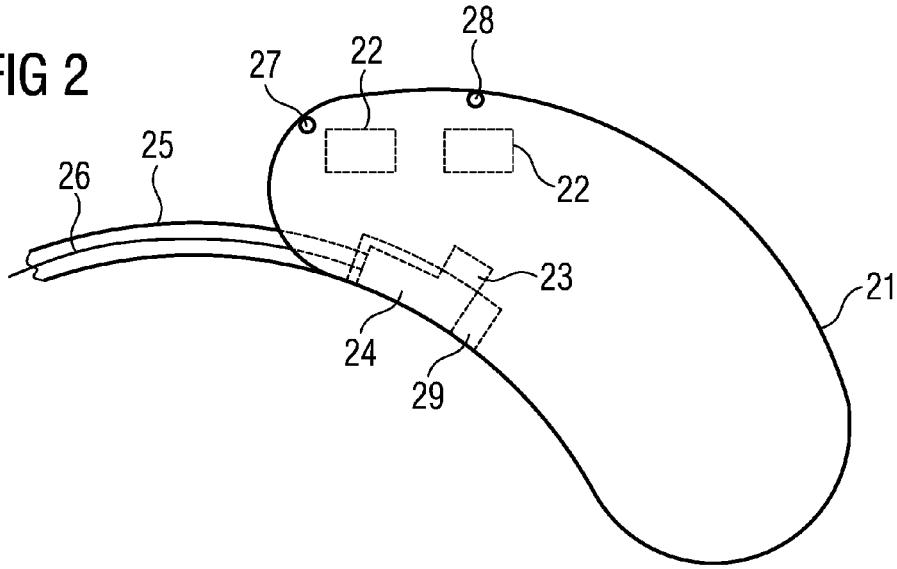
FIG. 2 shows a hearing device having a lateral plug-in connector and microphone on the front end face in the side view.

FIG. 2 shows a schematic representation of a side view of the RIC BTE hearing device having a lateral plug-in connector 23 and microphone 22 on the front end face. The hearing device includes a housing 21 to be worn behind the ear of a hearing device wearer. The housing 21 is usually embodied to be longitudinal for BTE hearing devices so that it comprises a relatively small frontal, front end face, one or several longitudinal side walls, and an approximately larger rear end face compared with the front end face surface.

Microphone 22 and plug-in connector 23 are arranged adjacent to further components which are usually required in the housing, for connection with an earpiece tube 25. The plug-in connector 23 is embodied as a socket. The earpiece tube 25 has a connector 24 which includes a plug-in connector. The connector 24 is placed in a connector receptacle 29 provided laterally on the housing 21. The plug-in connector of the connector 24 is in this way inserted into the socket of the plug-in connector 23. As a result, a receiver (not shown) arranged at the end of the earpiece tube 25 (similarly not shown) is electrically connected by means of the electrical line 26 running in the earpiece tube 25.

The lateral arrangement of the plug-in connector 23 similarly allows the earpiece tube 25 and the connector 24 to be arranged laterally on the housing 21. For this purpose, the connector 24 is embodied to be flat. This arrangement means that the connector 24 does not cover the front end face of the housing 21. The front end face can therefore be used in other ways and the front microphone position 27 is arranged there. A microphone opening (not shown) is disposed at the front microphone position 27 in the housing 21, to which one of the microphone 22 is connected. The microphone 22 can be arranged directly behind the microphone opening for instance, or can be connected to the microphone opening by means of a sound channel. The front microphone position 27 is therefore disposed overall further toward the front on the hearing device compared with a conventional RIC-BTE hearing device with an earpiece tube connector arranged at the front toward the end face. The rear microphone position 28, which for the purpose of spatial resolution of the sound detection has to be arranged spatially separate from the front, is moved as a whole further toward the front.

RIC BTE hearing devices are described above and below as exemplary embodiments in each instance, in which an earpiece tube connects a receiver positioned in the auditory canal of a hearing device wearer. Instead, BTE hearing devices would also be conceivable, in which the receiver sits in the housing of the hearing device and a sound tube leads into the auditory canal of the hearing device wearer. The respective plug-in connector for connecting the sound tube would, instead of the respective earpiece tube plug-in connector, likewise be arranged on the lower side wall of the respective housing and the same advantages would be achieved. In particular, the free space obtained in the region of the front end face of the housing would be used in each instance for one of the microphone positions.

Figure 3:
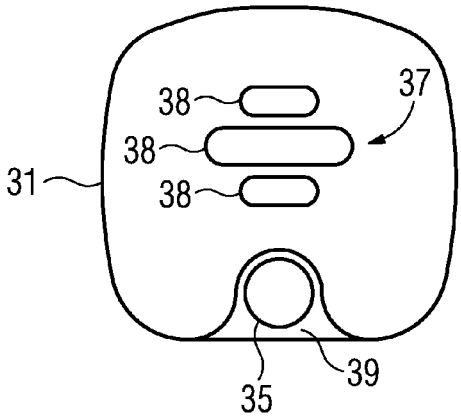
FIG. 3 shows a hearing device having a lateral plug-in connector and microphone on the front end face in the front view.

FIG. 3 shows a schematic representation of a hearing device with a lateral plug-in connector and a microphone on the front end face in the front view. Microphone openings 38, to which the associated microphone (not shown) is connected, are provided on the front microphone position 37 in the housing 31. The front microphone position 37 is visibly disposed on the front end face of the housing 31. The rear microphone position together with the microphone openings is not visible in the selected view.

A connector receptacle 39, into which the earpiece tube 35 is guided, is disposed on the lower side of the housing 31. The connector of the earpiece tube 35 and the plug-in connector between the earpiece tube 35 and the housing 31 are not visible in the selected view.

It is apparent that an arrangement of a correspondingly flat earpiece tube connector embodied with a minimal cross-section can be used to embody the housing 31 of the hearing device to be flat overall or less 2-dimensional, in order to increase wearing comfort and to achieve an aesthetically more pleasing design. In particular, the end face which is rather visible from the front is flatter or less 2-dimensional.

Figure 4:
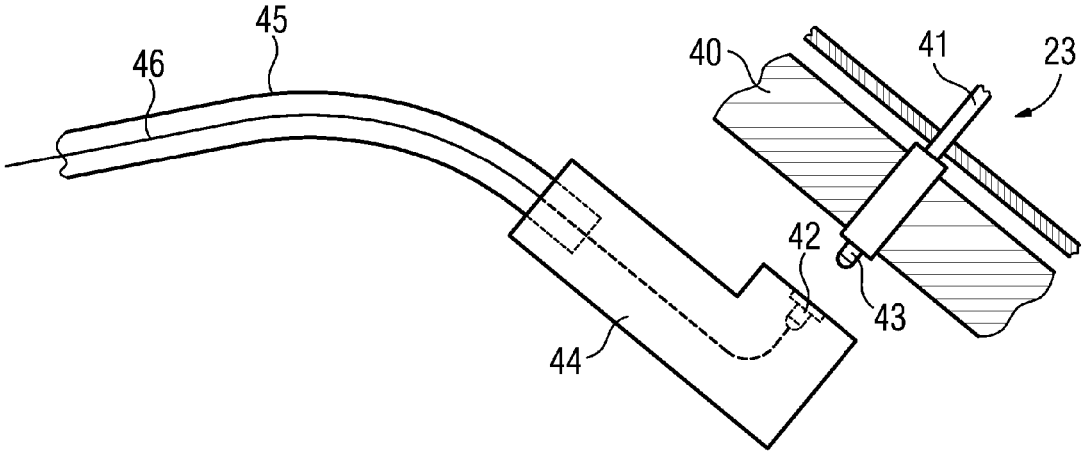
FIG. 4 shows a plug-in connector, earpiece tube and hearing device housing

FIG. 4 shows a schematic representation of a plug-in connector 23 between the earpiece tube 45 and the hearing device housing (not shown), which as described above, could be used arranged laterally on a hearing device housing. An electrical line 46, by means of which a receiver (not shown) arranged at the end of the earpiece tube 45 (likewise now shown) is connected, runs through the earpiece tube 45. The connector 44 of the earpiece tube 45 has a socket 42.

A connector 43 provided on the hearing device housing can be inserted into the socket 42. The connector 43 is part of the plug-in connector 23 and is arranged on a circuit carrier 40. A through connection 41 runs through the circuit carrier 40 and connects the connector 43 to electronic components of the hearing device (not shown), e.g. an output amplifier.

It is apparent that the connector 44 is plugged into the plug-in connector from below in a direction transversely to the side wall of the housing.

Figure 5:
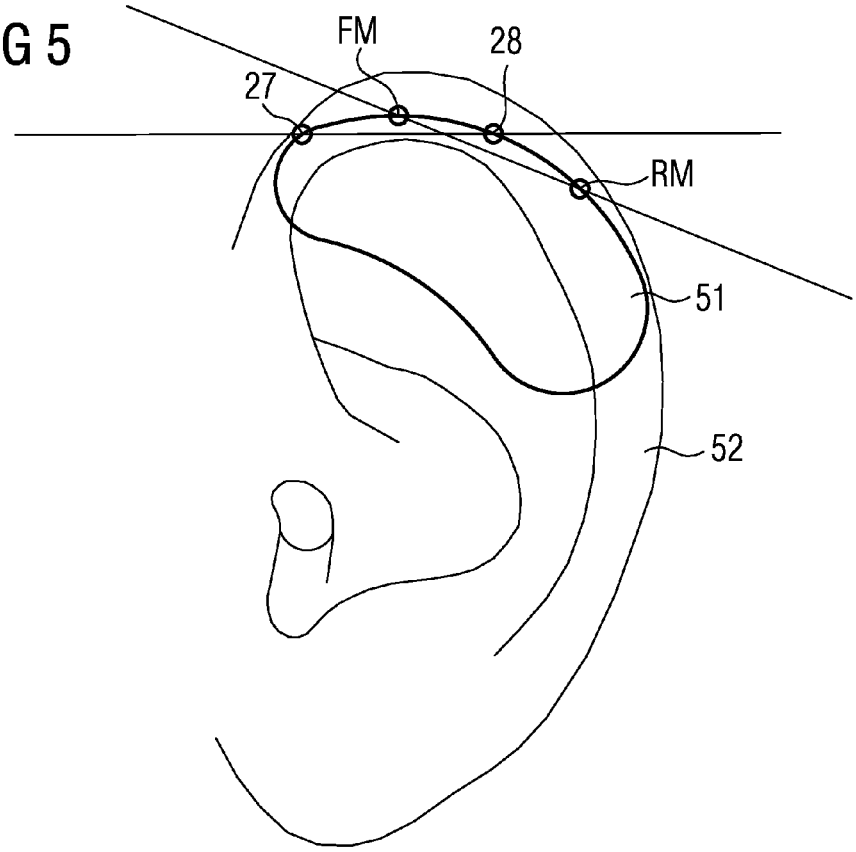
FIG. 5 shows a schematic representation of the microphone axis on the ear of a hearing device wearer.

FIG. 5 shows a schematic representation of the microphone axis on the ear of a hearing device wearer. The hearing device 51 is only drawn as a contour in order to be able to explain the possible microphone positions 27, 28, FM, RM thereupon. The contour of the auricle 52 is only indicated by the ear of the hearing device wearer, which nevertheless needs to be correctly reproduced to scale in the orientation relative to the housing 51.

The microphone positions FM and/or RM indicate the usual positions in a conventional RIC-BTE hearing device. The front microphone position FM (front microphone) is arranged on the upper side of the housing 51 and forms a rearwardly dropping line, as indicated in the drawing, with the further lower lying rear microphone position RM (rear microphone). The downwardly dropping line is produced by force since the microphone positions have to be arranged spatially separate in order to enable directionality and since on the other hand the housing drops rearwards from the front microphone position FM to the rear RM of the contour of the auricle 52. The varying heights of the spatial arrangement of the microphone positions FM and RM is less favorable with respect to the directionality than an arrangement of equal heights. It is also apparent that both microphone positions FM and RM are at least partially covered by the auricle 52, which hampers receipt of acoustic ambient signals. The front microphone position FM (and therefore also the rear) is to be moved further forwards but this is not possible since the front end face of the housing 51 is assumed with a conventional RIC-BTE hearing device of the earpiece tube connector (not shown).

Contrary to this, an inventive arrangement of the earpiece tube connector on the lateral wall of the housing 51 enables use of the front end face and/or the front end face area in another manner. According to the invention, the free front end face created in this way is used to arrange the front microphone position 27 there. Compared with a conventional front microphone position FR, the front microphone position 27 is therefore arranged further forwards on the housing 51. Accordingly, the rear microphone position 28 is also arranged further forwards. The two microphone positions 27 and 28 therefore form an at least approximately horizontal line, as indicated in the drawing. The spatial arrangement of the microphone positions 27 and 28 which are of approximately the same height is particularly favorable in respect of the directionality. Furthermore, it is apparent that at least the front microphone position 27 is comparably less significantly covered by the auricle 52, which favors receipt of acoustic ambient signals.

A basic idea behind the invention can be summarized as follows: the object of the invention consists in specifying an aesthetically pleasing BTE hearing device having a small front surface and improved acoustic properties. To this end, a hearing device is proposed with a housing 21, 31 to be worn behind the ear of a hearing device wearer, which has a plug-in connector 23, 43 for connection to an earpiece tube 25, 35, 45 or sound tube. The plug-in connector 23, 43 is arranged on a side wall of the housing 21, 31. The lateral arrangement of the plug-in connector moves the plug-in connector away from the exposed position on the front end face of the housing. As a result, the front end face of the housing which is generally visible at least from the front is generally made small in the case of a housing worn behind the ear. A particularly advantageous development provides at least two microphones 22, wherein one of the microphone positions 27 is arranged in the region of the front end face of the housing 21, 31. The front microphone position is thus moved further away from a position possibly covered by the auricle, and the rear microphone position can also be moved further toward the front as a result of a front microphone position arranged further toward the front. The microphone positions are thus approximately horizontal, which promotes the spatial resolution of the received ambient sound (directionality) by the signal processing of the hearing aid.

The invention claimed is:

1. A hearing device, comprising:

a housing to be worn behind the ear of a hearing device wearer, said housing having a side wall and an elongated shape;

a plug-in connector on said side wall of said housing for connection with an earpiece tube or a sound tube and said side wall with said plug-in connector being a longitudinal side wall of said housing;

an earpiece tube or sound tube having a connector configured for insertion into said plug-in connector;

said plug-in connector being arranged such that said connector of said earpiece tube or sound tube is inserted in a direction transversely to said side wall and said connector of said earpiece tube or sound tube is angled such that said earpiece tube or sound tube leaves said connector in a direction longitudinally to said side wall of said housing when said connector is inserted into said plug-in connector.

2. The hearing device according to claim 1, wherein said side wall with said plug-in connector is disposed on a side directed towards the ear when the housing is worn behind the ear of a hearing device wearer.

3. The hearing device according to claim 1, which further comprises a microphone connected to a microphone opening formed at a microphone position in a region of a front end face of said housing.

4. The hearing device according to claim 1, which comprises at least two microphones each connected to a respective microphone opening formed in said housing, and wherein said microphone openings are disposed at microphone positions that are spatially separate from one another and including one microphone position disposed in a region of a front end face of said housing.

5. The hearing device according to claim 1, which comprises at least two microphones each connected to a respective microphone opening formed in said housing, wherein said microphone openings are formed at microphone positions that are spatially separate from one another, and wherein one of said microphone positions is arranged in said longitudinal side wall of said housing and one of said microphone positions is arranged in a front end face of said housing.

* * * * *